US008995883B2

(12) United States Patent
Kuramashi et al.

(10) Patent No.: US 8,995,883 B2
(45) Date of Patent: Mar. 31, 2015

(54) DEVELOPING DEVICE AND IMAGE FORMING APPARATUS INCLUDING SAME

(71) Applicant: Kyocera Document Solutions Inc., Osaka (JP)

(72) Inventors: Koji Kuramashi, Osaka (JP); Tatsuya Yamanaka, Osaka (JP); Hirokazu Fujii, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/245,091

(22) Filed: Apr. 4, 2014

(65) Prior Publication Data

US 2014/0314450 A1 Oct. 23, 2014

(30) Foreign Application Priority Data

Apr. 23, 2013 (JP) ..... 2013-090517
May 23, 2013 (JP) ..... 2013-109237

(51) Int. Cl.
*G03G 15/08* (2006.01)

(52) U.S. Cl.
CPC ..... *G03G 15/0893* (2013.01); *G03G 15/0889* (2013.01)
USPC ..... 399/254; 399/255; 399/256

(58) Field of Classification Search
CPC ..... G03G 15/0889; G03G 15/0891; G03G 15/0893
See application file for complete search history.

(56) References Cited

U.S. PATENT DOCUMENTS

| | | | | |
|---|---|---|---|---|
| 5,724,635 | A * | 3/1998 | Nagaoka et al. | 399/260 |
| 2006/0216067 | A1 * | 9/2006 | Okoshi | 399/258 |
| 2012/0057904 | A1 | 3/2012 | Maehara et al. | 399/254 |
| 2012/0321355 | A1 * | 12/2012 | Saito et al. | 399/258 |

FOREIGN PATENT DOCUMENTS

| | | | |
|---|---|---|---|
| JP | 2006-11226 | A | 1/2006 |
| JP | 2007-147806 | A | 6/2007 |
| JP | 2012-53414 | A | 3/2012 |

* cited by examiner

*Primary Examiner* — Clayton E Laballe
*Assistant Examiner* — Peter L Cheng
(74) *Attorney, Agent, or Firm* — Stein IP, LLC

(57) ABSTRACT

A developing device includes a developing container, a first agitating/conveying member, a second agitating/conveying member, a developer supply member, a supply port, and a supply section. The developing container is separated into a developer supply passage, a first conveying chamber, and a second conveying chamber, which are arranged substantially parallel to one another. The supply section is disposed between the developer supply passage and the first conveying chamber, and through the supply section, the developer is supplied from the developer supply passage into the first conveying chamber. The supply section is disposed upstream from a downstream-side end portion of the developer supply passage but downstream from the supply port with respect to a developer-conveying direction of the developer supply passage, and via the supply section, the developer supply member supplies the developer into the first conveying chamber in a direction opposite to a developer-conveying direction of the first conveying chamber.

9 Claims, 5 Drawing Sheets

DEVELOPING DEVICE AND IMAGE FORMING APPARATUS INCLUDING SAME

INCORPORATION BY REFERENCE

This application is based upon and claims the benefit of priority from the corresponding Japanese Patent Application No. 2013-90517, filed on Apr. 23, 2013 and Japanese Patent Application No. 2013-109237, filed on May 23, 2013, the entire contents of which are incorporated herein by reference.

BACKGROUND

The present disclosure relates to a developing device incorporated in image forming apparatuses such as a copier, a facsimile, and a printer, and an image forming apparatus including the same, and in particular, the present invention relates to a method for reducing problems caused when toner is supplied, such as insufficient image density and fogging.

Known as conventional developing methods using a dry toner in an image forming apparatus employing an electrophotographic process are: a single-component developing method not using a carrier; and a two-component developing method of, by using a two-component developer for charging a non-magnetic toner with a magnetic carrier, developing an electrostatic latent image on an electrostatic latent image carrier (photosensitive body) with a magnetic brush of a toner and a carrier formed on a developing roller.

In a developing device, toner is consumed in a developing operation. Hence, there has been proposed a developing device in which, for the purpose of supplying toner to compensate for the amount consumed in a developing operation, a developer supply member is provided inside a developing container to supply developer to an agitating/conveying member.

For example, there has been known a developing device including first and second agitating/conveying members that agitate and convey developer, a developer supply member that rotates in the same direction as the first agitating/conveying member to supply the developer to the first agitating/conveying member, and a developing container that accommodates the first and second agitating/conveying members and the developer supply member. The developing container is provided with a supply section for supplying the developer from the developer supply member to the first agitating/conveying member. With this structure, by the rotation of the developer supply member, the developer is supplied from the developer supply member to the first agitating/conveying member in the supply section.

In such a developing device, toner is consumed through a developing operation. Hence, inside the developing device, there is provided a toner sensor that detects toner concentration (or toner amount), such that new toner is supplied to compensate for the amount consumed through the developing operation.

Here, when the developing device is operated continuously for a long time with a small amount of supply toner, as in a case where an image of a low printing rate is repeatedly printed and in a case where printing operations are repeated in an intermittent manner, mechanical stress on the toner circulating inside the developing device increases. As a result, electric charge on the toner in the developing device increases.

If, in this state, printing is performed at a high printing rate or continuously, initial toner charged to a comparatively low level is supplied into the developing device in a short period of time, and thus toner with a broad charge distribution is supplied to a developing roller, and this results in defective images such as those with insufficient image density and those with fogging.

To deal with this problem, there has been proposed a method for properly charging supply toner electrically, and there has been known a developing device in which, for example, a separation member and a pre-charging roller are provided in an agitating section, to thereby achieve stable charging of toner and reduce fogging occurring when toner is supplied anew.

There is also known a configuration where, in a developing device in which a supplying/conveying path, an agitating/conveying path, and collecting/conveying path are aligned substantially horizontally in this order from the vicinity of a developer regulating member, toner and carrier are supplied from a toner supplying position provided in the collecting/conveying path, and collected developer including the supplied toner and carrier is made to flow into the agitating/conveying path from a downstream-side end portion of the collecting/agitating path.

SUMMARY

According to one aspect of the present disclosure, a developing device includes: a developing container, a first agitating/conveying member, a second agitating/conveying member, a supply port, and a supply section. The developing container is separated into a developer supply passage, a first conveying chamber, and a second conveying chamber that are arranged substantially parallel to one another, and the developing container accommodates a developer including toner. The first agitating/conveying member agitates and conveys the developer in the first conveying chamber. The second agitating/conveying member agitates and conveys the developer in the second conveying chamber in a direction opposite to a direction in which the first agitating/conveying member agitates and conveys the developer. The developer supply member supplies the developer existing in the developer supply passage into the first conveying chamber. The supply port is provided in the developer supply passage to be connected to a developer supply mechanism. The supply section is provided between the developer supply passage and the first conveying chamber, and via the supply section, the developer is supplied from the developer supply passage into the first conveying chamber. The supply section is disposed upstream from a downstream-side end portion of the developer supply passage but downstream from the supply port with respect to a direction in which the developer is conveyed in the developer supply passage, and via the supply section, the developer supply member supplies the developer into the first conveying chamber in a direction opposite to a direction in which the developer is conveyed in the first conveying chamber.

Still other objects and specific advantages of the present disclosure will become apparent from the following descriptions of preferred embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
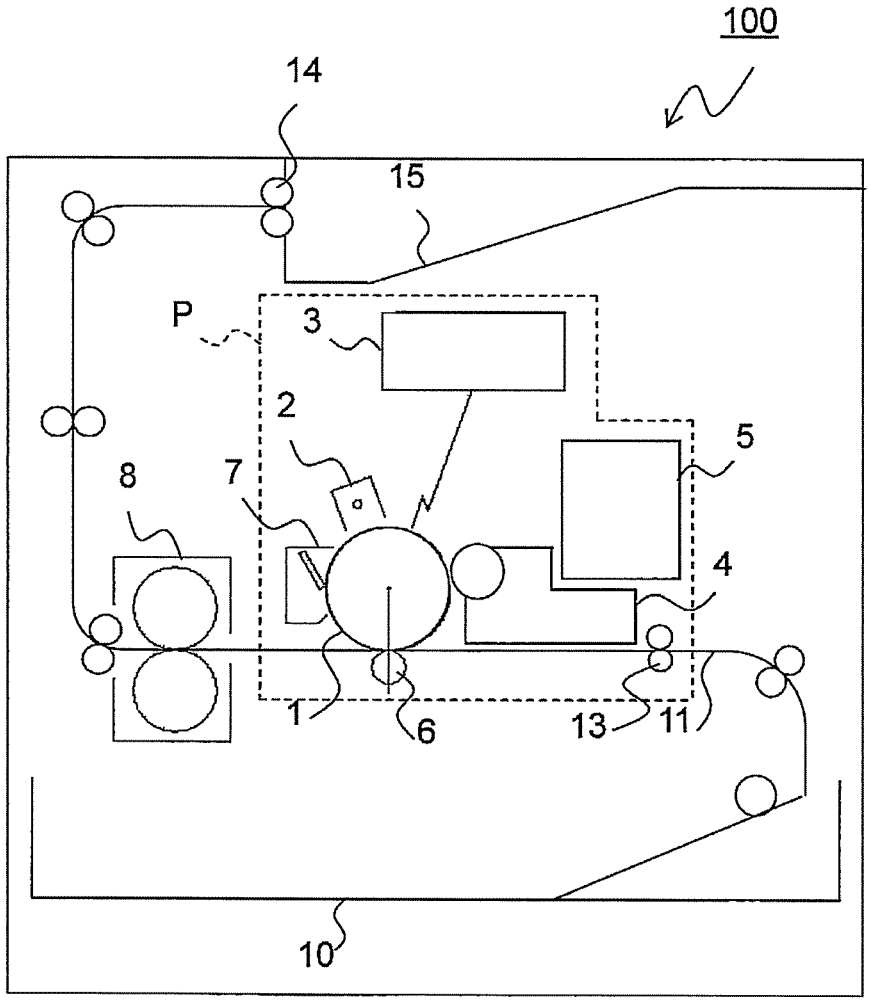
FIG. 1 is a schematic sectional view showing an overall configuration of an image forming apparatus 100 including a developing device 4 according to an embodiment of the present disclosure.

Hereinafter, embodiments of the present disclosure will be described with reference to the accompanying drawings. FIG. 1 is a schematic sectional view showing a configuration of an image forming apparatus 100 provided with a developing device 4 according to an embodiment of the present disclosure. In an image forming operation of the image forming apparatus 100 (for example, a monochrome printer), an electrostatic latent image is formed based on original image data sent from an unillustrated personal computer (PC) in an image forming section P inside a main body of the image forming apparatus 100, and then, the developing device 4 makes toner adhere to the electrostatic latent image to form a toner image. The toner supplied to the developing device 4 comes from a toner container 5. In the image forming apparatus 100, an image forming process is performed with respect to a photosensitive drum 1 while the photosensitive drum 1 is rotating in the clockwise direction in FIG. 1.

In the image forming section P, along a rotation direction of the photosensitive drum 1 (in the clockwise direction), there are arranged a charging section 2, an exposure unit 3, the developing device 4, a transfer roller 6, a cleaning device 7, and a charge neutralizing device (not shown). The photosensitive drum 1 has, for example, a photosensitive layer laid on an aluminum drum, and its surface is electrically charged by the charging section 2. When the surface is irradiated with a laser beam from the exposure unit 3, which will be described later, an electrostatic latent image is formed through attenuation of electric charge. Preferred as the photosensitive layer is, for example, but not limited to, amorphous silicon (a-Si), which is high in durability, or an organic photosensitive layer (OPC), which produces little ozone in charging and contributes to a high-resolution image.

The charging section 2 uniformly charges the surface of the photosensitive drum 1. Employed as the charging section 2 is, for example, a corona discharge device which produces electric discharge by applying a high voltage to an electrode such as a piece of fine wire. Instead of a corona discharge device, there may be employed a contact-type charging device which achieves voltage application while a charging member, as exemplified by a charging roller, is in contact with the surface of a photosensitive drum. The exposure unit 3 irradiates the photosensitive drum 1 with a light beam (for example, a laser beam) according to image data, and thereby forms an electrostatic latent image on the surface of the photosensitive drum 1.

The developing device 4 makes toner adhere to the electrostatic latent image formed on the photosensitive drum 1 to form a toner image. Here, a magnetic single-component developer (hereinafter may also be simply referred to as toner) composed of a magnetic toner component alone is accommodated in the developing device 4. The details of the developing device 4 will be described later. The transfer roller 6 transfers, without disturbing, the toner image formed on the surface of the photosensitive drum 1 onto a sheet of paper which is conveyed along a sheet conveying passage 11. The cleaning device 7 is provided with a cleaning roller, cleaning blade, and the like which make line contact with the photosensitive drum 1 in a longitudinal direction thereof, to remove residual toner remaining on the surface of the photosensitive drum 1 after the transfer of the toner image onto the sheet.

Based on the image data, which has been inputted beforehand, the exposure unit 3 irradiates the photosensitive drum 1 with a laser beam (light beam), and thereby, an electrostatic latent image based on the image data is formed on the surface of the photosensitive drum 1. Then, the developing device 4 makes toner adhere to the electrostatic latent image to form a toner image.

Toward the image forming section P in which the toner image is formed as described above, a sheet of paper is conveyed at predetermined timing from a paper accommodating section 10 via the paper conveying passage 11 and a registration roller pair 13 such that, in the image forming section P, the transfer roller 6 transfers the toner image on the surface of the photosensitive drum 1 onto the sheet. Then, the sheet carrying the transferred toner image is separated from the photosensitive drum 1, and is conveyed to a fixing section 8, where application of heat and pressure is performed on the sheet to thereby fix the toner image thereon. The sheet having passed through the fixing section 8 is ejected via an ejection roller pair 14 into a sheet ejection section 15.

Figure 2:
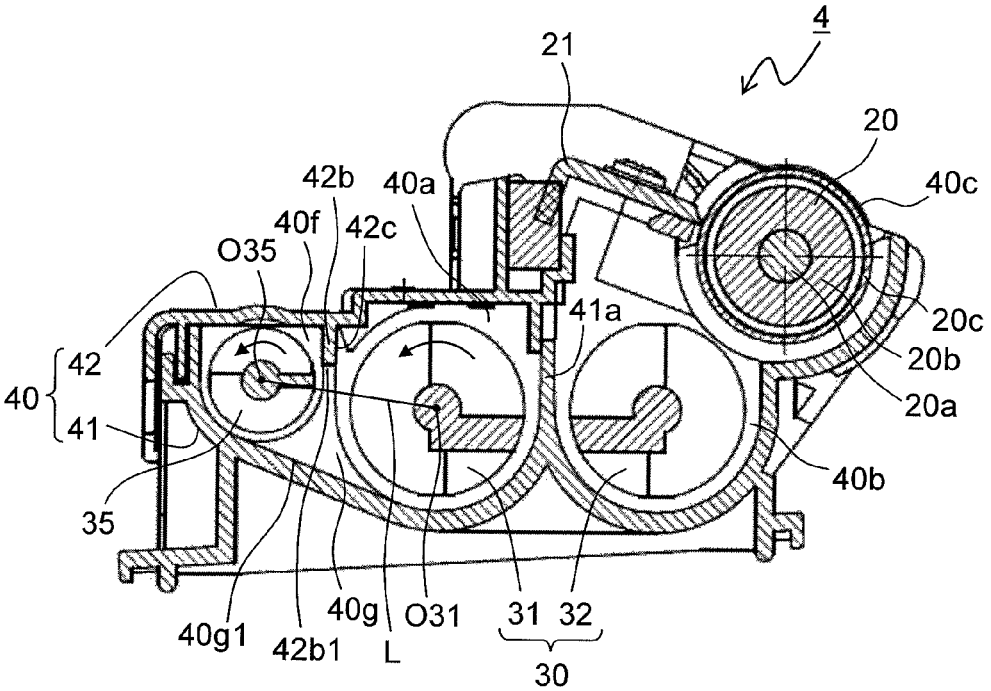
FIG. 2 is a side sectional view showing a structure of the developing device 4 of the present embodiment.

FIG. 2 is a side sectional view showing a structure of the developing device 4. Detailed descriptions will be given of the structure of the developing device 4 with reference to FIG. 2. Note that FIG. 2 shows a state as seen from a rear surface side of FIG. 1, and the arrangement of the members inside the developing device 4 is reversed left to right compared with the arrangement in FIG. 1.

As shown in FIG. 2, the developing device 4 includes a developing roller (developer carrier) 20, a regulating blade 21, an agitating/conveying member 30, a developer supply member 35, a developing container 40 in which these components are accommodated, and the like.

The developing container 40 constitutes an outer casing of the developing device 4, and has a main body 41 and a cover member 42 that covers an upper portion of, for example, the developer supply member 35. The developing container 40 is separated into a first conveying chamber 40*a* and a second conveying chamber 40*b* by a partition 41*a* provided in the main body 41. A single-component developer composed of toner alone is accommodated in the first conveying chamber 40*a* and the second conveying chamber 40*b*. The developing container 40 rotatably holds the agitating/conveying member 30, the developer supply member 35, and the developing roller 20. The developing container 40 is further provided with an opening 40*c* through which the developing roller 20 is exposed toward the photosensitive drum 1 (see FIG. 1).

The developing roller 20 is arranged to face the photosensitive drum 1 with a predetermined distance therebetween. The developing roller 20 supplies toner to the photosensitive drum 1 in a facing region where the developing roller 20 is close to the photosensitive drum 1. The agitating/conveying member 30 is located obliquely downward to the left of the developing roller 20. The regulating blade 21 is fixedly held by the developing container 40 on the left of the developing roller 20.

The agitating/conveying member 30 includes two spirals, namely, a first spiral (first agitating/conveying member) 31 and a second spiral (second agitating/conveying member) 32. The second spiral 32 is disposed inside the second conveying chamber 40*b* to be located obliquely downward to the left of the developing roller 20, and the first spiral 31 is disposed inside the first conveying chamber 40*a* to be located adjacent to the left of the second spiral 32.

The first and second spirals 31 and 32 convey the developer while agitating it. At both end portions in a longitudinal direction (a direction perpendicular to the plane of FIG. 2) of the partition 41*a* that separates the first and second conveying chambers 40*a* and 40*b* from each other, communication sections (an upstream-side communication section 40*d* and a downstream-side communication section 40*e* which will be described later) are provided such that, when the first spiral 31 rotates, the developer is conveyed to the second spiral 32 via one of the communication sections provided in the partition 41*a*, and thus the developer circulates in the first conveying chamber 40*a* and the second conveying chamber 40*b*. Then, the developer is supplied from the second spiral 32 to the developing roller 20.

The developing roller 20 includes a stationary shaft 20*a*, a magnetic pole member 20*b*, a developing sleeve 20*c* that is a cylindrical member formed of a nonmagnetic metal material. The developing roller 20 is made to rotate in the counterclockwise direction in FIG. 2 by an unillustrated drive mechanism that includes a motor and a gear.

When the developing sleeve 20*c* having a developing bias applied thereto rotates, the toner carried on the developing sleeve 20*c* flies to the photosensitive drum 1 in a developing region (the facing region where the developing roller 20 and the photosensitive drum 1 face each other), due to a potential difference between the developing bias and the potential of an exposed part of photosensitive drum 1. The flying toner sequentially adheres to the exposed part of the rotating photosensitive drum 1, and thereby, an electrostatic latent image on the photosensitive drum 1 is developed.

Figure 3:
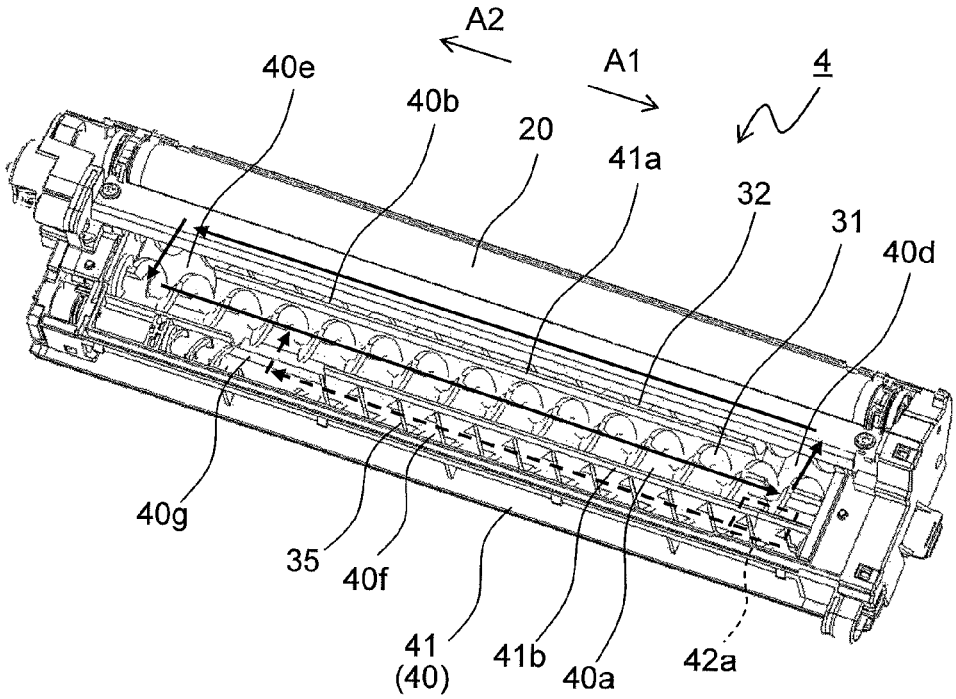
FIG. 3 is an external perspective view showing a state where a cover member 42 of the developing device 4 of the present embodiment is removed.
Figure 4:
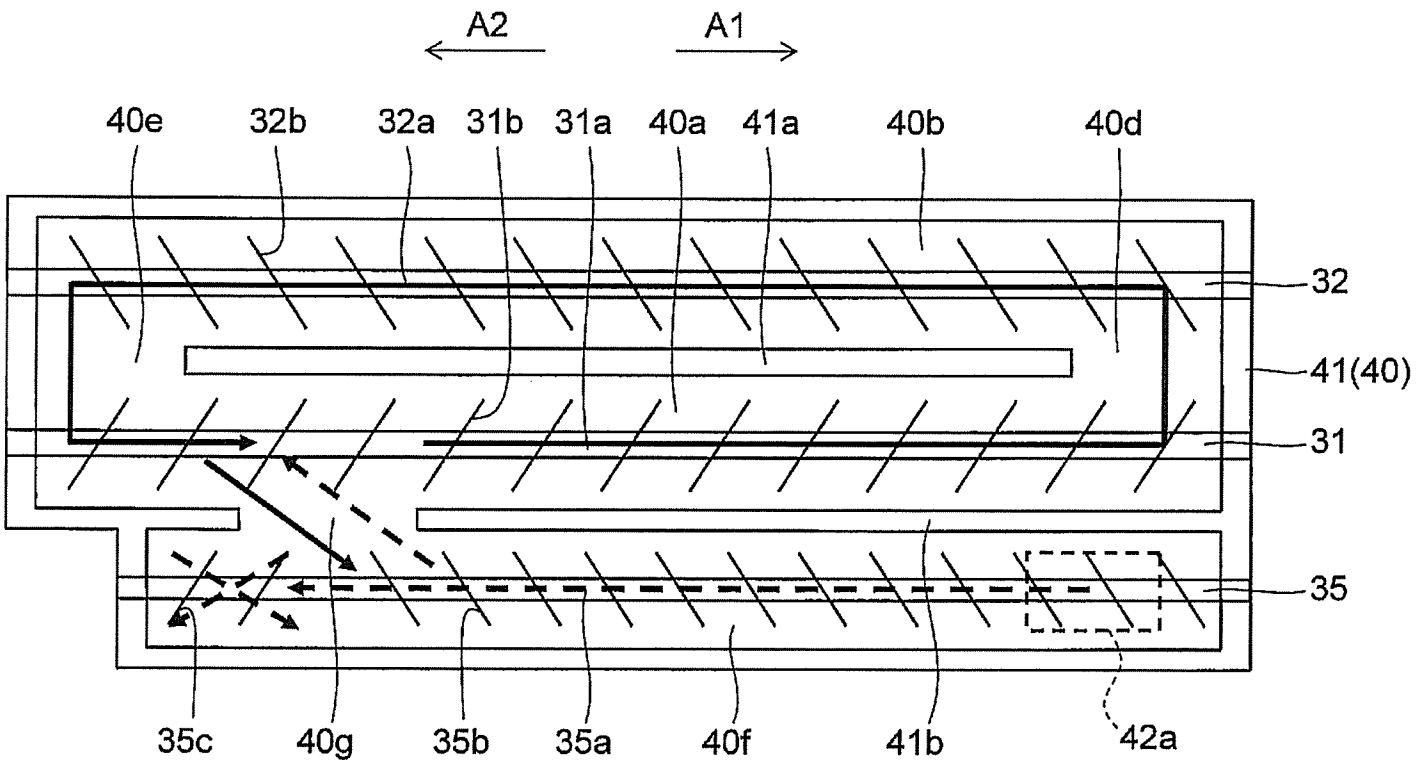
FIG. 4 is a plan sectional view showing a structure of an agitating section of the developing device 4 of the present embodiment.

FIG. 3 is an external perspective view showing a state where the cover member 42 of the developing device 4 is removed, and FIG. 4 is a plan sectional view showing a structure of an agitating section of the developing device 4. As shown in FIG. 3 and FIG. 4, the partition 41*a*, the first conveying chamber 40*a*, the second conveying chamber 40*b*, and the communication sections 40*d* and 40*e* are provided in the developing container 40, and in addition, there is also provided a developer supply passage 40*f*. The developer supply passage 40*f* is a passage for supplying a new developer (supply toner) from the toner container 5 to the first conveying chamber 40*a*.

The first conveying chamber 40*a*, the second conveying chamber 40*b*, and the developer supply passage 40*f* are arranged parallel to one another. The partition 41*a* is provided to extend in the longitudinal direction of the developing container 40 so as to separate the first conveying chamber 40*a* and the second conveying chamber 40*b* from each other. A partition 41*b* is provided to extend in the longitudinal direction of the developing container 40 so as to separate the developer supply passage 40*f* and the first conveying chamber 40*a* from each other. In the first conveying chamber 40*a*, the left side in FIG. 3 is the upstream side while the right side in FIG. 3 is the downstream side. In the second conveying chamber 40*b*, the right side in FIG. 3 is the upstream side while the left side in FIG. 3 is the downstream side.

The communication sections 40*d* and 40*e* are provided at one and the other longitudinal end portions (direction-A1 end portion and direction-A2 end portion) of the partition 41*a*, respectively. The communication section 40*d* allows the direction-A1 end portions of the first and second conveying chambers 40*a* and 40*b* to communicate with each other. The communication section 40*e* allows the direction-A2 end portions of the first and second conveying chambers 40*a* and 40*b* to communicate with each other. In this configuration, the developer is able to circulate in the first conveying chamber 40*a*, the communication section 40*d*, the second conveying chamber 40*b*, and the communication section 40*e*.

Figure 5:
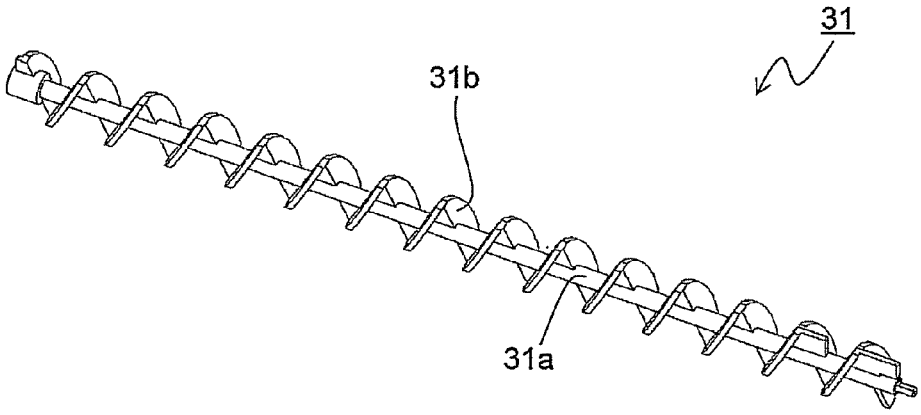
FIG. 5 is a perspective view showing a structure of a first spiral 31 employed in the developing device 4 of the present embodiment.

FIG. 5 is a perspective view showing a structure of the first spiral 31 employed in the developing device 4. As shown in FIGS. 3 to 5, the first spiral 31 includes a rotation shaft 31*a* and a first spiral blade (blade) 31*b* that is integral with the rotation shaft 31*a* and that has a shape of a spiral at a predetermined pitch along the axial direction of the rotation shaft 31*a*. The rotation shaft 31*a* is pivotally supported by the developing container 40. The first spiral blade 31*b* conveys the developer inside the first conveying chamber 40*a* in direction A1 while agitating the developer.

The second spiral 32 has the same structure as the first spiral 31 shown in FIG. 5, except that orientations (phases) of the spiral blades are different. That is, the second spiral 32 includes a rotation shaft 32*a* and a second spiral blade 32*b*. The second spiral blade 32*b* is integral with the rotation shaft 32*a* and has a shape of a spiral at the same pitch as the first spiral blade 31*b* along the rotation shaft 32*a* in its axial direction. The second spiral blade 32*b* is reversely oriented (reversely phased) with respect to the first spiral blade 31*b*. The rotation shaft 32*a* is arranged parallel to the rotation shaft 31*a*, and is pivotally supported by the developing container 40. The second spiral blade 32*b* supplies the developer to the developing roller 20 by conveying the developer inside the second conveying chamber 40*b* in direction A2 (a direction opposite to direction A1) while agitating the developer.

Figure 6:
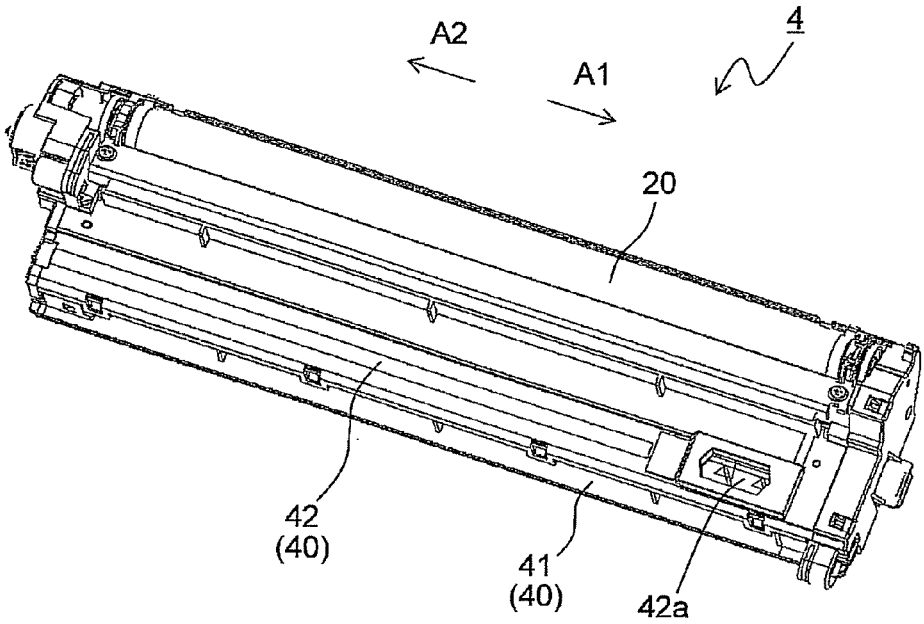
FIG. 6 is an external perspective view of the developing device 4 of the present embodiment.

As shown in FIG. 6, in a portion of the developer supply passage 40*f* on the direction-A1 side, there is provided a supply port 42*a* in the cover member 42 to supply a new developer therethrough into the developing container 40 from the toner container 5 that is disposed above the developing container 40. On an inner wall of the first conveying chamber 40*a* or the second conveying chamber 40*b*, there is provided a toner sensor (not shown) for detecting an amount of toner in the developing container 40. According to detection results of the toner sensor, toner (developer) accommodated in the toner container 5 (see FIG. 1) is supplied into the developing container 40 through the supply port 42*a*.

The developer supply passage 40*f* is a passage for conveying in direction A2 the developer that is supplied to the portion thereof on the direction-A1 side, to thereby supply the developer to the upstream side of the first conveying chamber 40*a*. In the developer supply passage 40*f*, there is provided a supply section 40*g* for supplying the developer from the developer supply passage 40*f* to the first conveying chamber 40*a*. With respect to a direction in which the developer is conveyed in the developer supply passage 40*f* (direction A2), the supply section 40*g* is located upstream from a downstream-side end portion (left end portion in FIG. 4) of the developer supply passage 40*f* (the upstream is the right side in FIG. 4) but downstream from the supply port 42*a* (the downstream side is the left side in FIG. 4).

Figure 7:
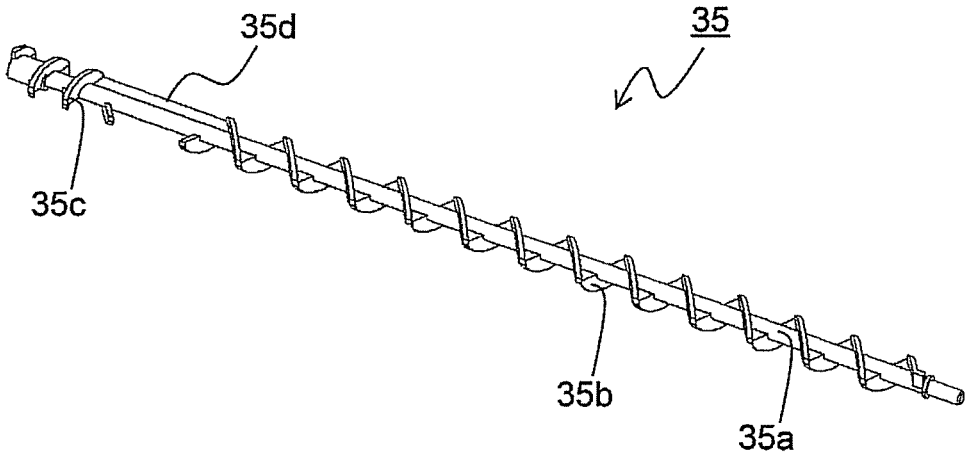
FIG. 7 is a perspective view showing a structure of a developer supply member 35 employed in the developing device 4 of the present embodiment.

In the developer supply passage 40*f*, the developer supply member 35 is arranged parallel to the first and second spirals 31 and 32. As shown in FIG. 3 and FIG. 7, the developer supply member 35 includes a rotation shaft 35*a* and third and fourth spiral blades 35*b* and 35*c* that are integral with the rotation shaft 35*a*. The third spiral blade 35*b* is formed in a spiral shape along the rotation shaft 35*a* in its axial direction.

The third spiral blade 35*b* is reversely oriented (reversely phased) with respect to the first spiral blade 31*b*, and extends from the supply port 42*a* (see FIG. 6) to the supply section 40*g*. The fourth spiral blade 35*c* is formed in a spiral shape and reversely oriented (reversely phased) with respect to the third spiral blade 35*b*, and extends from the supply section 40*g* to a direction A2 end portion. Further, on the rotation shaft 35*a*, at a portion thereof facing the supply section 40*g*, there is provided a paddle-shaped conveying blade 35*d*.

The developer supply member 35 is configured to rotate in the same direction as the first spiral 31 (in the counterclockwise direction in FIG. 2), such that the developer supplied to the supply port 42*a* is conveyed toward the supply section 40*g*. Since the third spiral blade 35*b* and the fourth spiral blade 35*c* have phases opposite in direction to each other, the developer conveyed by the third spiral blade 35*b* and the developer conveyed by the fourth spiral blade 35*c* collide with each other in the supply section 40*g* to be conveyed to the first conveying chamber 40*a*.

The developer supply member 35, the first spiral 31, and the second spiral 32 are each driven to rotate by an unillustrated drive mechanism including a motor and a gear.

As shown in FIG. 2, the developer supply member 35 supplies the developer from below upward to the first spiral 31 by rotating in the counterclockwise direction. In an upper portion of the supply section 40*g* (a portion of the supply section 40*g* downstream from the developer supply member 35 with respect to a rotation direction of the developer supply member 35), a rib 42*b* is provided to extend downward (toward the upstream side with respect to the rotation direction of the developer supply member 35). A side 42*c* of the rib 42*b* on the first spiral 31 side is a flat surface extending in a vertical direction. The rib 42*b* is provided to extend substantially all along a width direction (direction A1 and direction A2) of the supply section 40*g*. Further, the rib 42*b* is made of resin and integral with the cover member 42.

An edge 42*b*1 (lower edge) of the rib 42*b* is located on a side above line L that connects a center O35 of the developer supply member 35 and a center O31 of the first spiral 31 (that is, on a downstream side of line L with respect to the rotation direction of the developer supply member 35). Further, the edge 42*b*1 of the rib 42*b* is located above the center O35 of the developer supply member 35. The center O35 of the developer supply member 35 is located at a position higher than the center O31 of the first spiral 31. A bottom 40*g*1 of the supply section 40*g* is inclined downward from the developer supply passage 40*f* toward the first conveying chamber 40*a*.

According to the present embodiment, as described above, in the upper portion of the supply section 40*g* (a portion on the downstream side with respect to the rotation direction of the developer supply member 35), the rib 42*b* is provided to extend downward (upstream with respect to the rotation direction of the developer supply member 35). This makes it possible to reduce backflow of the developer into the developer supply passage 40*f* from the first conveying chamber 40*a* caused by the first spiral 31 in an upper portion of the supply section 40*g*. This contributes to improvement of the efficiency of supplying the developer from the developer supply member 35 to the first spiral 31 (from the developer supply passage 40*f* to the first conveying chamber 40*a*).

Furthermore, as described above, the edge 42*b*1 of the rib 42*b* is located on a side above line L that connects the center O35 of the developer supply member 35 and the center O31 of the first spiral 31 (that is, on the downstream side of line L with respect to the rotation direction of the developer supply member 35). This makes it possible to reduce blockage caused by the rib 42*b* in the supply of the developer from the developer supply member 35 to the first spiral 31, and thus to achieve more efficient supply of the developer.

Moreover, as described above, the center O35 of the developer supply member 35 is located at a position higher than the center O31 of the first spiral 31, and the edge 42*b*1 of the rib 42*b* is located above the center O35 of the developer supply member 35. This makes it possible to further reduce blockage caused by the rib 42*b* in the supply of the developer from the developer supply member 35 to the first spiral 31.

Also, as has described above, the developer supply member 35 rotates so as to supply the developer from below upward to the first spiral 31, and the rib 42*b* is disposed in the upper portion of the supply section 40*g*. As a result, in comparison with a case where the developer supply member 35 is made to rotate so as to supply the developer from above downward to the first spiral 31 and the rib 42*b* is disposed in a lower portion of the supply section 42*g*, it is possible to easily improve the efficiency of supplying the developer from the developer supply member 35 to the first spiral 31.

Also, as described above, the rib 42*b* is integral with the cover member 42. This facilitates production of the rib 42*b*, reducing increase of components in number.

Furthermore, as described above, the side 42*c* of the rib 42*b* on the first spiral 31 side is a flat surface extending in the vertical direction. As a result, in comparison with a case where the side 42*c* of the rib 42*b* on the first spiral 31 side is, for example, an arc-like surface curved along an area where the blade of the first spiral 31 passes, it is possible to reduce backflow of the developer from the first spiral 31 to the developer supply member 35. This makes it possible to further improve the efficiency of supplying the developer from the developer supply member 35 to the first spiral 31.

Moreover, as described above, the bottom 40*g*1 of the supply section 40*g* is inclined downward from the developer supply passage 40*f* toward the first conveying chamber 40*a*. This makes it possible to easily improve the efficiency of supplying the developer from the developer supply member 35 to the first spiral 31.

As shown in FIG. 2 and FIG. 4, the supply section 40*g* is an opening having a predetermined opening width in a horizontal direction (right-left direction in FIG. 4), and a predetermined opening width in a perpendicular direction (up-down direction in FIG. 2). If the opening width in the perpendicular direction is smaller than an outer diameter of the developer supplying member 35 (a diameter of the third and fourth spiral blade 35*b* and 35*c*), it is impossible to achieve sufficient toner supplying performance. On the other hand, if the opening width in the perpendicular direction is larger than the outer diameter of the developer supply member 35, it causes backflow of the toner from the first conveying chamber 40*a* to the developer supply passage 40*f*. To prevent these inconveniences, the supply section 40*g* is formed such that the opening width in the perpendicular direction is substantially equal to the outer diameter of the developer supply member 35.

In the present embodiment, as has been discussed above, toner (developer) supplied into the developer supply passage 40*f* from the supply port 42*a* is conveyed through the developer supply passage 40*f* in direction A2 (as indicated by a broken line arrow in FIG. 4). On the other hand, the toner inside the first conveying chamber 40*a* is conveyed in direction A1 (as indicated by a solid line arrow in FIG. 4). Then, the toner conveyed in the developer supply passage 40*f* in direction A2 joins, in the supply section 40*g*, circulation toner conveyed in direction A1 while circulating in the first conveying chamber 40*a*.

With this feature, in feeding supply toner from the developer supply passage 40*f* into the first conveying chamber 40*a*, the supply toner conveyed through the developer supply passage 40*f* in direction A2 and the circulation toner conveyed in the first conveying chamber 40*a* in direction A1 collide with each other near the supply section 40*g*, such that part of the circulation toner in the first conveying chamber 40*a* is taken from the supply section 40*g* into the developer supply passage 40*f*, to be agitated with the supply toner. As a result, the supply toner in the developer supply passage 40*f* and the circulation toner in the first conveying chamber 40*a* are fully agitated and mixed together in the supply section 40*g*, and this makes it possible to quickly achieve uniform distribution of toner electric charge in the developing container 40. Thus, it is possible to reduce occurrence of problems such as deficient image density caused by excessively charged toner and image fogging caused by insufficiently charged toner.

Here, the supply section 40*g* is disposed upstream from the downstream-side (direction A2-side) end portion of the developer supply passage 40*f* with respect to the direction in which the developer is conveyed in the developer supply passage 40*f*, and the developer supply passage 40*f* extends downstream past the supply section 40*g* with respect to the direction in which the developer is conveyed in the developer supply passage 40*f*. Between the supply section 40*g* and the direction A2-side end portion, the fourth spiral blade 35*c* is provided to be reversely oriented (reversely phased) with respect to the third spiral blade 35*b*. With this feature, near the supply section 40*g*, a toner current is caused to occur by the fourth spiral blade 35*c*. Thus, it is possible to agitate the toner existing near the supply section 40*g* and including both the supply toner and the circulation toner more efficiently.

Moreover, the supply section 40*g* is disposed downstream from the upstream-side communication section 40*e* that is located on the upstream side with respect to the direction in which the developer is conveyed in the first conveying chamber 40*a* (direction A1). This feature allows the circulation toner inside the first conveying chamber 40*a* and the supply toner inside the developer supply passage 40*f* to collide with each other from opposite directions to be fully agitated and mixed together.

Here, if the supply section 40*g* is disposed in the vicinity of the supply port 42*a*, toner that is just supplied from the supply port 42*a* and thus is not electrically charged yet might be immediately fed into the first conveying chamber 40*a*, and fogging might be caused by the insufficient charge of the toner. To prevent this by separating the supply port 42*a* from the supply section 40*g* as much as possible, it is preferable, as in the present embodiment, to dispose the supply port 42*a* at the upstream-side end portion (right side in FIG. 6) with respect to the direction in which the developer is conveyed in the developer supply passage 40*f*, and dispose the supply section 40*g* closer to the downstream-side end portion (left side in FIG. 6) than the center portion of the developer supply passage 40*f*.

It should be understood that the present disclosure is not limited to the above embodiments, and various modifications are possible within the scope of the present disclosure. For example, the above embodiment employs the first and second spirals 31 and 32 where the spiral blades 31*b* and 32*b* are continuously provided along the rotation shafts 31*a* and 32*a*, respectively, but this is not meant as a limitation. Instead, there may be employed an agitating/conveying member such that, for example, a plurality of semilunar plates (each obtained by dividing a circular plate in half) are alternately arranged at a predetermined inclination angle along the rotation shafts 31*a* and 32*a*.

Furthermore, the above-discussed embodiments have dealt with examples where the developer supply member rotates so as to supply the developer from below upward to the first agitating/conveying member, but this is not meant as a limitation, and the developer supply member may supply the developer from above downward to the first agitating/conveying member. In this case, a rib should be disposed in the lower portion (a portion on the downstream side with respect to the rotation direction of the developer supply member) of the supply section. Moreover, the center O35 of the developer supply member 35 may be located at a position higher than the center O31 of the first spiral 31, and the edge of the rib 42*b* may be located below the center O31 of the first spiral 31.

Also, the above-discussed embodiments have dealt with examples where the rib 42*b* is integrally formed with the cover member 42, but this is not meant as a limitation. For example, a rib may be integrally formed with the partition 41*b* that separates the developer supply passage 40*f* and the first conveying chamber 40*a* from each other.

In addition, the above-discussed embodiments have dealt with examples where a single-component developer composed of toner alone is used as the developer, but this is not meant as a limitation, and a two-component developer composed of carrier and toner may be used as the developer.

The application of the present disclosure is not limited to monochrome printers as illustrated in FIG. 1, but the present disclosure is applicable to various image forming apparatuses such as digital or analog monochrome copiers, color printers, color copiers, facsimile machines, and the like that incorporate a developing device including the first agitating/conveying member, the second agitating/conveying member, and the developer supply member.

The present disclosure is adaptable for use in developing devices that include the developer supply passage, the first conveying chamber, and the second conveying chamber which are arranged substantially parallel to one another. Adoption of the present disclosure makes it possible to quickly achieve uniform distribution of toner charge, and thus to obtain an image forming apparatus that is capable of reducing occurrence of defective images such as those with insufficient image density and those with fogging.

What is claimed is:

1. A developing device, comprising:

a developing container that accommodates a developer including toner, the developing container being separated into a developer supply passage, a first conveying chamber, and a second conveying chamber that are arranged substantially parallel to one another;

a first agitating/conveying member that agitates and conveys the developer in the first conveying chamber;

a second agitating/conveying member that agitates and conveys the developer in the second conveying chamber in a direction opposite to a direction in which the first agitating/conveying member agitates and conveys the developer;

a developer supply member that supplies the developer existing in the developer supply passage into the first conveying chamber;

a supply port disposed in the developer supply passage to be connected to a developer supply mechanism; and a supply section that is disposed between the developer supply passage and the first conveying chamber to supply the developer from the developer supply passage into the first conveying chamber therethrough, the supply section being located upstream from a downstream-side end portion of the developer supply passage but downstream from the supply port with respect to a direction in which the developer is conveyed in the developer supply passage, the developer supply member supplying the developer to the first conveying chamber through the supply section in a direction opposite to a direction in which the developer is conveyed in the first conveying chamber, wherein a rib is disposed in a portion of the supply section such that the rib extends upstream with respect to a rotation direction of the developer supply member when the supply section is viewed in an axial direction of the developer supply member;

an edge of the rib is located downstream from a line connecting a center of the developer supply member and a center of the first agitating/conveying member with respect to the rotation direction of the developer supply member;

the center of the developer supply member is located at a position higher than the center of the first agitating/conveying member; and in a case where the developer supply member supplies the developer to the first agitating/conveying member from below, the rib is formed as a rib that extends downward from an upper portion of the supply section such that the edge of the rib is located above the center of the developer supply member, while in a case where the developer supply member supplies the developer to the first agitating/conveying member from above, the rib is formed as a rib that extends upward from a lower portion of the supply section such that the edge of the rib is located below the center of the first agitating/conveying member.

2. The developing device of claim 1, wherein two communication sections are provided to establish communication between the first conveying chamber and the second conveying chamber at both end portions of the first conveying chamber and the second conveying chamber; and the supply section is disposed downstream from an upstream-side of one of the two communication sections with respect to the direction in which the developer is conveyed in the first conveying chamber.

3. The developing device of claim 1, wherein the supply port is disposed at an upstream-side end portion of the developer supply passage with respect to the direction in which the developer is conveyed in the developer supply passage; and the supply section is disposed downstream from a center portion of the developer supply passage with respect to the direction in which the developer is conveyed in the developer supply passage.

4. The developing device of claim 1, wherein the developer supply member comprises a rotation shaft and a spiral blade disposed on an outer circumferential surface of the rotation shaft; and the spiral blade comprises a spiral blade disposed substantially between the supply section and the downstream-side end portion of the developer supply passage and a spiral blade disposed substantially between the supply section and an upstream-side end portion of the developer supply passage, the spiral blade disposed substantially between the supply section and the downstream-side end portion of the developer supply passage and the spiral blade disposed substantially between the supply section and the upstream-side end portion of the developer supply passage being opposite to each other in phase.

5. The developing device of claim 1, wherein the supply section is an opening having a predetermined opening width in a horizontal direction and a predetermined opening width in a perpendicular direction, and the opening width of the supply section in the perpendicular direction is substantially equal to an outer diameter of the developer supply member.

6. The developing device of claim 1, wherein a side of the rib facing the first agitating/conveying member is a flat surface extending in an up-down direction.

7. The developing device of claim 1, wherein a bottom of the supply section is inclined downward from the developer supply passage toward the first conveying chamber.

8. An image forming apparatus comprising the developing device of claim 1.

9. A developing device, comprising:

a developing container that accommodates a developer including toner, the developing container being separated into a developer supply passage, a first conveying chamber, and a second conveying chamber that are arranged substantially parallel to one another;

a first agitating/conveying member that agitates and conveys the developer in the first conveying chamber;

a second agitating/conveying member that agitates and conveys the developer in the second conveying chamber in a direction opposite to a direction in which the first agitating/conveying member agitates and conveys the developer;

a developer supply member that supplies the developer existing in the developer supply passage into the first conveying chamber;

a supply port disposed in the developer supply passage to be connected to a developer supply mechanism; and a supply section that is disposed between the developer supply passage and the first conveying chamber to supply the developer from the developer supply passage into the first conveying chamber therethrough, the supply section being located upstream from a downstream-side end portion of the developer supply passage but downstream from the supply port with respect to a direction in which the developer is conveyed in the developer supply passage, the developer supply member supplying the developer to the first conveying chamber through the supply section in a direction opposite to a direction in which the developer is conveyed in the first conveying chamber, wherein a rib is disposed in a portion of the supply section such that the rib extends upstream with respect to a rotation direction of the developer supply member when the supply section is viewed in an axial direction of the developer supply member;

an edge of the rib is located downstream from a line connecting a center of the developer supply member and a center of the first agitating/conveying member with respect to the rotation direction of the developer supply member;

the center of the developer supply member is located at a position higher than the center of the first agitating/conveying member;

the developing container is constituted with a cover member disposed above the first agitating/conveying member;

the developer supply member supplies the developer to the first agitating/conveying member from below;

the rib extends downward from an upper portion of the supply section such that the edge of the rib is located above the center of the developer supply member;

and the rib that extends downward from the upper portion of the supply section is integral with the cover member.

* * * * *